US008228250B2

(12) United States Patent
Sato et al.

(10) Patent No.: US 8,228,250 B2
(45) Date of Patent: Jul. 24, 2012

(54) COMPOSITE ANTENNA APPARATUS

(75) Inventors: Kyuichi Sato, Tokyo (JP); Junichi Noro, Tokyo (JP); Takeshi Iizuka, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 565 days.

(21) Appl. No.: 12/427,971

(22) Filed: Apr. 22, 2009

(65) Prior Publication Data

US 2009/0267847 A1 Oct. 29, 2009

(30) Foreign Application Priority Data

Apr. 23, 2008 (JP) ..... P2008-112536

(51) Int. Cl.
*H01Q 1/32* (2006.01)
*H01Q 1/36* (2006.01)
*H01Q 21/30* (2006.01)

(52) U.S. Cl. ..... 343/715; 343/725; 343/895; 343/906

(58) Field of Classification Search ..... 343/705, 343/713, 715, 872, 873, 900, 700 MS, 725, 343/729, 895, 906
See application file for complete search history.

(56) References Cited

U.S. PATENT DOCUMENTS 3,945,013 A * 3/1976 Brunner et al. ..... 343/708
5,300,936 A * 4/1994 Izadian ..... 343/700 MS
5,610,620 A * 3/1997 Stites et al. ..... 343/725
6,054,966 A * 4/2000 Haapala ..... 343/895
6,879,294 B2 * 4/2005 Yuanzhu ..... 343/725

FOREIGN PATENT DOCUMENTS

| | | |
|---|---|---|
| JP | 61-46601 | 3/1986 |
| JP | 6-252621 | 9/1994 |
| JP | 10-93327 | 4/1998 |
| JP | 10-290115 | 10/1998 |
| JP | 2001-339227 | 12/2001 |
| JP | 2001-358525 | 12/2001 |
| JP | 2002-26646 | 1/2002 |
| JP | 2002-314312 | 10/2002 |
| JP | 2005-130532 | 5/2005 |
| JP | 2006-254049 | 9/2006 |
| JP | 2008-61175 | 3/2008 |

OTHER PUBLICATIONS

Japanese Office Action with Translation dated Mar. 3, 2010.

* cited by examiner

*Primary Examiner* — Michael C Wimer
(74) *Attorney, Agent, or Firm* — Whitham, Curtis, Christofferson & Cook, P.C.

(57) ABSTRACT

A composite antenna apparatus is disclosed. A rod member accommodates a first antenna element and a second antenna element therein. A base member accommodates a circuit board therein. A connector couples an end portion of the rod member and the base member. The connector includes a first conductive member configured to transmit a first signal received by the first antenna element to the circuit board therethrough, and a second conductive member configured to transmit a second signal received by the second antenna element to the circuit board therethrough.

13 Claims, 11 Drawing Sheets

COMPOSITE ANTENNA APPARATUS

BACKGROUND

The present invention relates to a composite antenna apparatus.

As is well known in this technical field, various sorts of antenna apparatuses are presently mounted on vehicles. For instance, as these antenna apparatuses, antennas designed for SDARS (Satellite Digital Audio Radio Service), antennas designed for GPS (Global Positioning System), antennas designed for wireless telephone systems, antennas designed for AM/FM radios, and other antennas are proposed.

The SDARS (Satellite Digital Audio Radio Service) provides such services realized by a digital broadcasting system by utilizing satellites (will be referred to as "SDARS satellites" hereinafter) in The United States. That is, in The United States, It is developed and practically utilized a digital radio receiver capable of receiving digital broadcast programs by receiving either satellite waves or ground waves transmitted from the SDARS satellites. At the present stage, two broadcasting stations called as "XM" and "Sirius" provide 250, or more channels of radio programs in total so as to cover all states in The United States. Generally speaking, the above-described digital radio receivers are mounted on moving objects such as automobiles, and are capable of receiving electromagnetic waves in frequency bands of approximately 2.3 GHz to listen to digital ratio programs. In other words, digital radio receivers are such radio receivers capable of listening to mobile broadcasting programs. Since frequencies of received electromagnetic waves are present in approximately 2.3 GHz band, reception wavelengths at this time are approximately 128.3 mm. As to the above-described ground wave, after a satellite wave is once received by an earth station, a frequency of the received satellite wave is slightly shifted, and then, the satellite wave is re-transmitted based upon a linearly-polarized wave. In other words, the satellite wave corresponds to electromagnetic waves of a circularly-polarized wave, whereas the ground wave corresponds to electromagnetic waves of a linearly-polarized wave.

An XM satellite radio antenna apparatus receives electromagnetic waves of the circularly-polarized wave from two geostationary satellites, and also, receives electromagnetic waves of the linearly-polarized wave from ground linearly polarized wave facilities in an insensitive zone. On the other hand, a Sirius satellite radio antenna apparatus receives electromagnetic waves of the circularly-polarized wave from three earth orbiters, and also, receives electromagnetic waves of the linearly-polarized wave from ground linearly-polarized wave facilities in an insensitive zone.

As previously described, in digital radio broadcasting systems, since the electromagnetic waves having the frequencies of the approximately 2.3 GHz band are used, there are many cases that antenna apparatuses which receive these electromagnetic waves are set outdoors. As a consequence, in order that digital radio receivers are mounted on moving objects such as automobiles, antenna apparatuses of these digital radio receivers are mounted outside vehicle rooms, for instance, on roofs.

As SDARS antennas capable of receiving electromagnetic waves of the circularly-polarized wave, flat planar antennas such as patch antennas, and also, cylindrical type antennas such as helical antennas are used. Generally speaking, cylindrical type antennas may be popular, as compared with flat planar antennas. The reason why the cylindrical type antennas are more popular is that wide directivity may be achieved, since antennas are formed in cylindrical forms.

A description is made of helical antennas which constitute one of the cylindrical type antennas (refer to, Patent Document 1). While the helical antennas contain such a structure that at least one conducting wire is wound in a helix shape on a circumferential portion of a cylindrical member, the helical antennas can receive the above-explained electromagnetic waves of the circularly-polarized wave with higher efficiency. As a consequence, the helical antennas are employed in order solely to receive satellite waves. As materials of the cylindrical member, insulating materials such as plastic are used. Generally speaking, in order to improve reception sensitivities thereof, plural pieces (for instance, four pieces) of conducting wires are employed.

It is very difficult to wind plural pieces of conducting wires on a cylindrical member in a helix form. Under such a circumstance, the following helical antennas are proposed in Patent Document 2. That is, antenna patterns made of a plurality of conducting wires are printed on one face of an insulating film member having flexibility and provided with the antenna pattern. Then, this insulating film member provided with the antenna pattern is wound on a cylindrical member.

It should also be noted that in such a case that a helical antenna has a structure where a plurality of conducting wires are wound on a cylindrical member in a helix-shaped form, phases as to a plurality of satellite waves which are electromagnetic waves of circularly polarization mode are shifted from each other by a phase shifter in order that these shifted phases are made coincident with each other, while these plural satellite waves are received by plural pieces of these helix conducting wires of this helical antenna. After these satellite waves whose phases are coincident with each other are synthesized with each other, the synthesized satellite wave is amplified by a low noise amplifier (LNA), and then, the amplified satellite wave is transmitted to a main body of a receiver.

Another helical antenna is proposed in Patent Document 3. That is, in this helical antenna, both an antenna pattern constructed of four pieces of conductors and a phase shifter pattern electrically connected to the above-described antenna pattern are formed on one face of an insulating film member having flexibility and provided with antenna/phase shifter pattern.

On the other hand, as 3-wave commonly receivable antennas capable of receiving electromagnetic waves transmitted in a wireless telephone band, an FM radio band, and an AM radio band, rod antennas are known in this field. In any way, rod antennas are employed as wireless telephone-purpose antennas and AM/FM radio antennas. Rod antennas are constructed by winding electric wires on metal bodies, or glass fiber rods.

Furthermore, composite antennas capable of utilizing any of satellite communications and ground communications are proposed. For instance, a Patent Document 4 discloses a commonly receivable antenna constructed by arranging a monopole antenna on a substantially center axis within a dielectric cylinder which constructs a circularly polarization wave antenna. Also, a Patent Document 5 discloses such a composite antenna constituted by a four-line helical antenna and a monopole antenna. In this composite antenna, while four pieces of conductors are wound on a side face of a cylindrical dielectric body, a power supplying circuit is connected to the 4-line helical antenna, and supplies high frequency power to these four conductors in such a manner that phases of the high frequency power are sequentially different from each other by 90 degrees. The monopole antenna is provided on a substantially center axis of the cylindrical dielectric body.

On the other hand, GPS (Global Positioning System) is a satellite positioning system with employment of satellites. In the above-described GPS system, electromagnetic waves (GPS signals) are received which are transmitted from four GPS satellites among twenty-four GPS satellites which are orbiting the earth; a positional relationship between a moving object and the GPS satellites, and temporal errors are measured based upon the received electromagnetic waves; and then, a position and an altitude of the moving object on a map can be calculated based upon the principle of the trigonometrical survey.

The GPS system is utilized in car navigation systems and the like, which detect positions of traveling automobiles, and is widely popularized. A car navigation apparatus is arranged by a GPS antenna for receiving GPS signals; a processing apparatus for processing the GPS signals received by this GPS antenna so as to detect a present position of a vehicle; a display apparatus for displaying the present position detected by the processing apparatus on a map of a monitor; and the like. As the GPS antenna, a planar antenna such as a patch antenna is utilized.

Another composite antenna apparatus is proposed in which a planar antenna such as an SDARS antenna and a GPS antenna is mounted on a major face of an antenna base in addition to the above-described 3-wave commonly receivable antenna rod antenna capable of receiving electromagnetic waves transmitted in the portable wireless telephone band, the FM radio band, and the AM radio band (refer to, Patent Document 6).

[Patent Document 1] Japanese Patent Publication No. 2001-339227 A

[Patent Document 2] Japanese Patent Publication No. 2001-358525 A

[Patent Document 3] Japanese Patent Publication No. 2006-254049 A

[Patent Document 4] Japanese Patent Publication No. 10-290115 A

[Patent Document 5] Japanese Patent Publication No. 2002-314312 A

[Patent Document 6] Japanese Patent Publication No. 2008-61175A

As previously described, the Patent Document 4 and the Patent Document 5 disclose the composite antenna apparatuses constituted by two the antenna elements, namely, the helical antennas and the monopole antennas. In the composite antenna apparatuses having such structures, these two antenna elements are stored in the rod portion and the circuit board on which the electronic circuit such as the LNA circuit is mounted is stored in the base portion in order that the rod portion must be connected to the base portion in a mechanical manner and also an electric manner so that signals can be transmitted.

However, Patent Document 4 and Patent Document 5 neither disclose nor teach how to connect the rod portions with the base portions in the mechanical manners and electric manners so that signals can be transmitted.

Also, in such a case of the composite antenna apparatus arranged by the rod portions and the base portions, as previously explained, the signals are required to be transmitted between the rod portions and the base portions. In this case, normally, the following method may be employed. That is, while a first reception signal received by a helical antenna (first antenna element) is coupled with a second reception signal received by a monopole antenna (second antenna element) by a coupling device (coupler), the coupled signal is transmitted via a transmit path of a single line, and then, the coupled signal is separated into two original signals by a signal separator mounted on a circuit board. However, in such a signal transmit method, distribution losses (coupling/separating losses) may occur. As a result, there is such a problem that reception sensitivities measured in the respective elements of the composite antenna apparatuses are deteriorated.

In the composite antenna apparatus described in the above-mentioned Patent Document 6, two sets of the planar antennas are mounted on the major face of the antenna base. As a result, there is such a problem that if these two planar antennas are approximated to each other, then these planar antennas may interface with each other due to directivity thereof. In order to solve this interference problem, when the distance between these two planar antennas is increased, although the interference may be decreased, there is another problem that the resulting dimension of the composite antenna apparatus is increased.

SUMMARY

It is therefore one advantageous aspect of the present invention to provide a composite antenna apparatus capable of readily connecting a rod portion to a base portion in a mechanical manner and also an electric manner so that signals can be transmitted.

It is therefore one advantageous aspect of the present invention to provide a composite antenna apparatus in which the rod portion can be easily mounted and also dismounted with respect to the base portion.

It is therefore one advantageous aspect of the present invention to provide a composite antenna apparatus capable of transmitting signals between the rod portion and base portion with less distribution loss, and also, capable of improving reception sensitivities of respective antenna elements.

It is therefore one advantageous aspect of the present invention to provide a composite antenna apparatus capable of eliminating interference which occurs between the antenna elements, which can be made compact.

According to one aspect of the invention, there is provided a composite antenna apparatus comprising:

a first antenna element;

a second antenna element;

a rod member accommodating the first antenna element and the second antenna element therein;

a circuit board;

a base member accommodating the circuit board therein; and a connector coupling an end portion of the rod member and the base member, the connector comprising:

a first conductive member configured to transmit a first signal received by the first antenna element to the circuit board therethrough; and a second conductive member configured to transmit a second signal received by the second antenna element to the circuit board therethrough.

The composite antenna apparatus may be configured such that: the composite antenna apparatus is configured to be disposed on either a roof or a quarter panel of a vehicle.

The composite antenna apparatus may be configured such that: the connector comprises a first part provided on the end portion of the rod member and a second part provided on the base member and configured to be coupled with the first part.

The composite antenna apparatus may be configured such that: the first part and the second part are configured to be detachably screw-fitted with each other.

The composite antenna apparatus may be configured such that: the first part of the connector is protruded from the end portion of the rod member and formed with a male screw; and the second part of the connector is formed with a female screw configured to fit with the male screw.

The composite antenna apparatus may be configured such that: the first conductive member is provided in the first part of the connector and includes: a first inner conductive member being concentric with an axis of the rod member; and a first outer conductive member covering the first inner conductive member and formed with the male screw; and the second conductive member is provided in the second part of the connector and includes: a second inner conductive member electrically connected to the first inner conductive member and the circuit board; and a second outer conductive member electrically connected to the first outer conductive member and the circuit board, the second outer conductive member covering the second inner conductive member and formed with the female screw.

The composite antenna apparatus may be configured such that: the first antenna element includes a helical antenna having a tubular body; and the second antenna element includes a rod antenna disposed in the tubular body.

The composite antenna apparatus may be configured such that: the rod antenna is configured to receive an AM broadcast and a FM broadcast.

The composite antenna apparatus may be configured such that: the helical antenna is configured to receive electric waves of a Satellite Digital Audio Radio Service.

The composite antenna apparatus may be configured such that: the base member comprises a cover and a plate; the circuit board comprises a first circuit board and a second circuit board which extend parallel to each other and perpendicularly to the plate; the first circuit board is electrically connected to the second inner conductive member, the second circuit board is electrically connected to the second outer conductive member.

The composite antenna apparatus may further comprise: a third antenna element mounted on the circuit board.

The composite antenna apparatus may be configured such that: the third antenna element comprises a planar antenna.

The composite antenna apparatus may be configured such that: the planar antenna comprises a patch antenna.

The composite antenna apparatus may be configured such that: the third antenna element is configured to serve as a GPS antenna receiving a GPS signal.

The composite antenna apparatus may further comprise: a connector cover extending from the end portion of the rod member and covering the first part.

DETAILED DESCRIPTION OF EXEMPLIFIED EMBODIMENTS

Exemplified embodiments of the invention are described below in detail with reference to the accompanying drawings.

Figure 1:
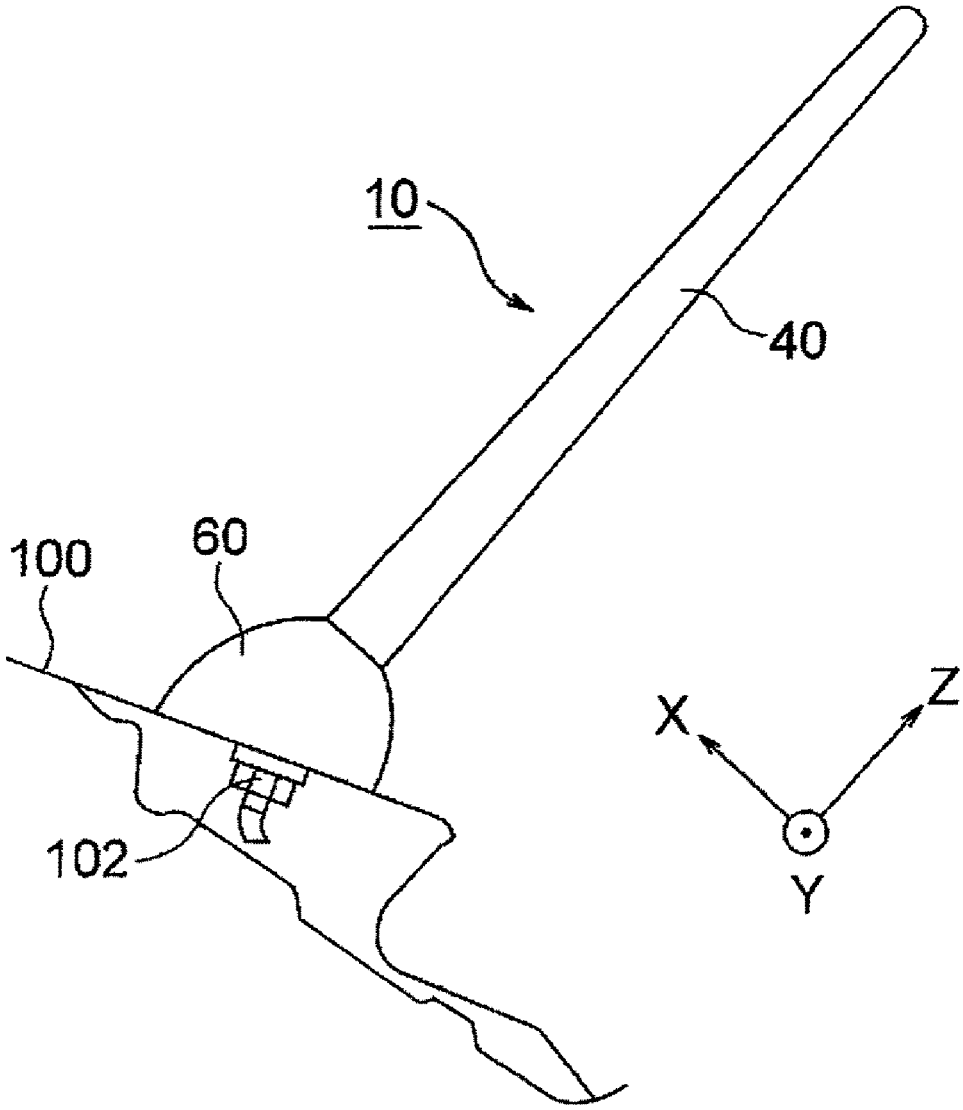
FIG. 1 is a right side view of a condition that a composite antenna apparatus according to a first embodiment of the invention is fixed on a vehicle body.
Figure 2:
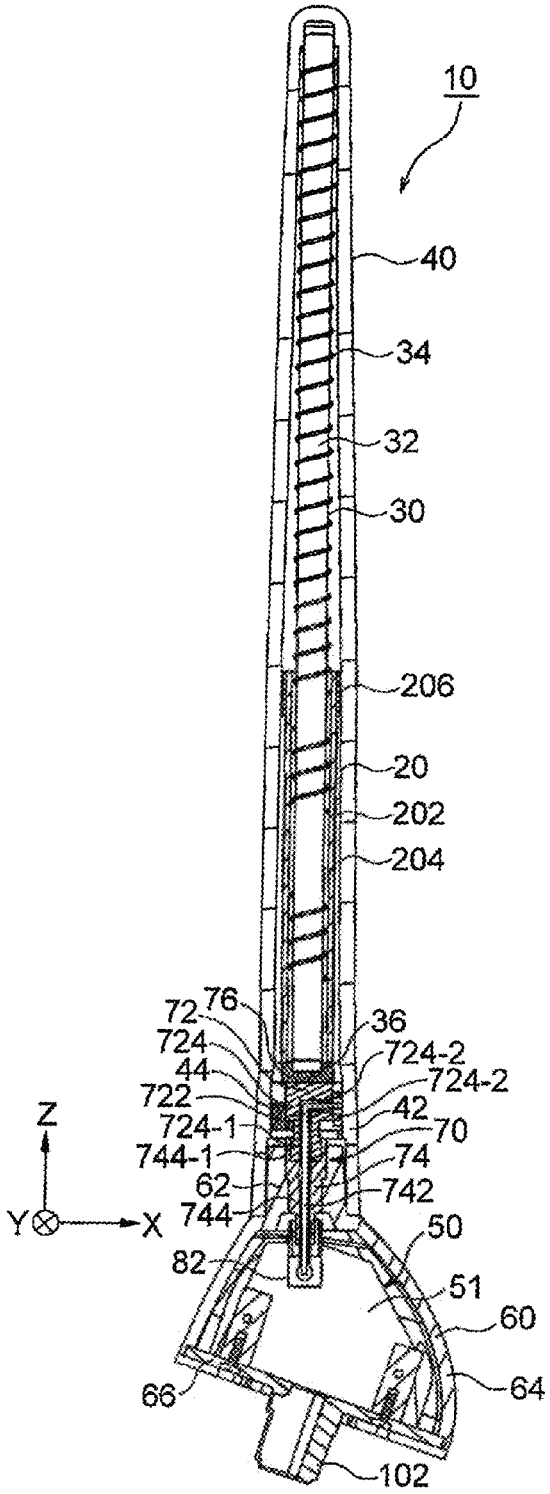
FIG. 2 is a sectional view of a left side portion of the composite antenna apparatus.
Figure 3:
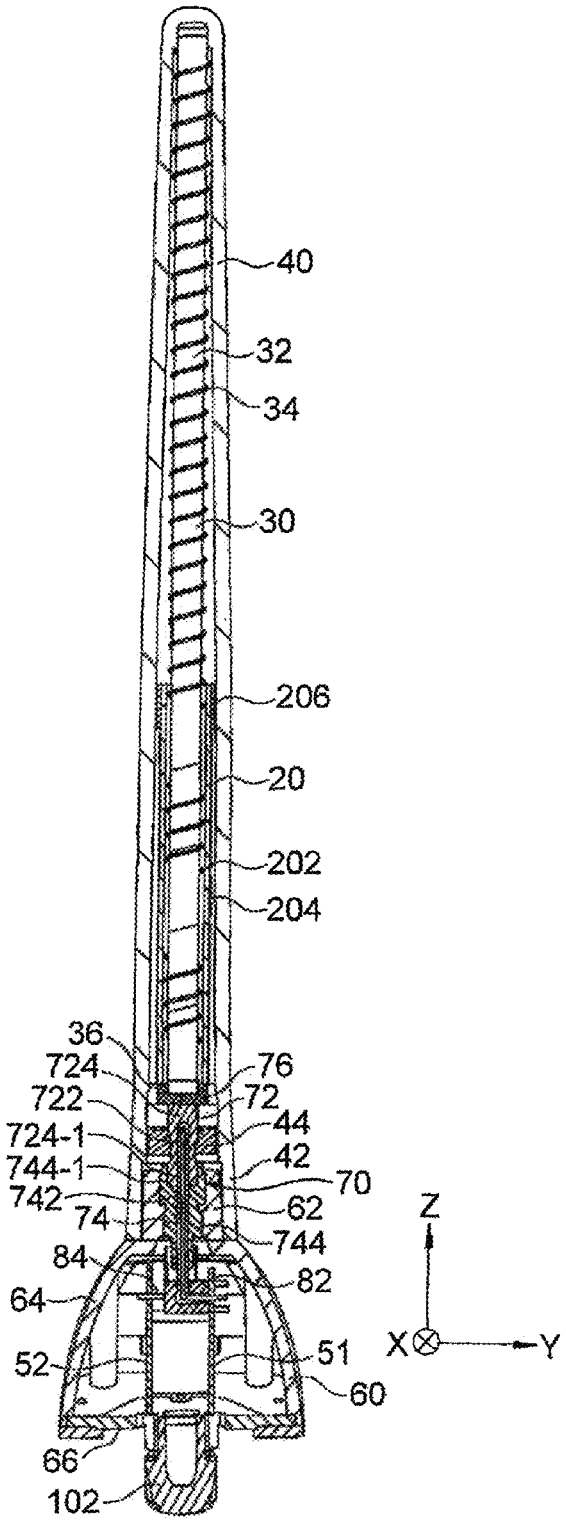
FIG. 3 is a sectional view of a front face portion of the composite antenna apparatus.

As shown in FIGS. 1 to 3, a description is made of a composite antenna apparatus 10 according to a first embodiment of the present invention. In FIGS. 1 to 3, a longitudinal direction (height direction) is expressed by a Z-axis direction along which a hollow rod portion 40 (will be discussed later) is elongated; a right and left direction (width direction) is expressed by a Y-axis direction; and further, a direction (front-rear direction, namely depth direction) which is intersected with the Z-axis direction and the Y-axis direction at a right angle is expressed by an X-axis direction.

As shown in FIG. 1, the composite antenna apparatus 10 shown in the drawings is mounted on a rear edge portion, or a quarter panel of a roof 100 of the vehicle body.

The composite antenna apparatus 10 is hollowed with a first antenna element 20, a second antenna element 30, a hollow rod portion 40, a circuit board 50, and a base portion 60. The hollow rod portion 40 stores the first antenna element 20 and the second antenna element 30. The circuit board 50 has an electronic circuit. The base portion 60 stores the circuit board 50. The hollow rod portion 40 is constructed of a material having flexibility.

As will be explained later, the hollow rod portion 40 is connected to the base portion 60 in a mechanical manner by a connector 70 at a proximal end portion 42 of this hollow rod portion 40. The above-described connector 70 has another function capable of transmitting a first reception signal received by the first antenna element 20 and a second reception signal received by the second antenna element 30 to the circuit board 50 (will be discussed later). As previously explained, since the connector 70 is employed in order to connect the hollow rod portion 40 to the base portion 60, the hollow rod portion 40 can be easily connected to the base portion 60 in a mechanical manner and an electric manner so that signals can be transmitted. The first reception signal may be the SDARS signal, for example, and the second reception signal may be the AM-FM signal, for example.

The connector 70 is constituted by a first coaxial connecting portion 72 provided at the proximal end portion 42 of the hollow rod portion 40, and a second coaxial connecting portion 74. The second coaxial connecting portion 74 is provided at the base portion 60, and is engaged with the first coaxial connecting portion 72. The connector 70 shown in the drawing is constructed of a screw type connector capable of detachably mounting the hollow rod portion 40 with respect to the base portion 60. Therefore, the hollow rod portion 40 can be readily mounted and dismounted with respect to the base portion 60.

Figure 4:
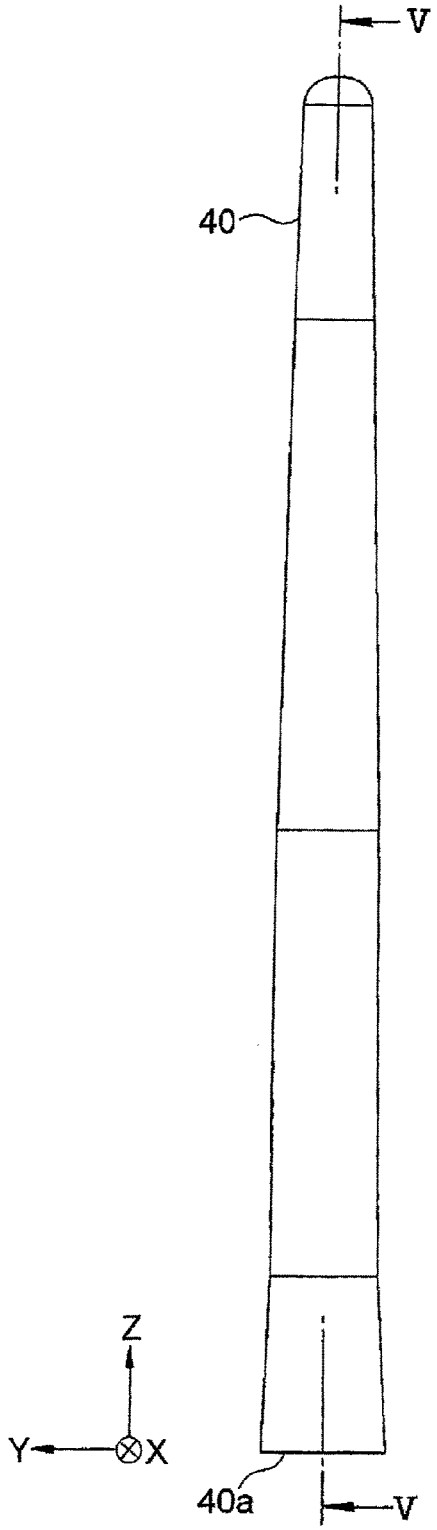
FIG. 4 is a rear view of an outer appearance of the rod portion of the composite antenna apparatus.
Figure 5:
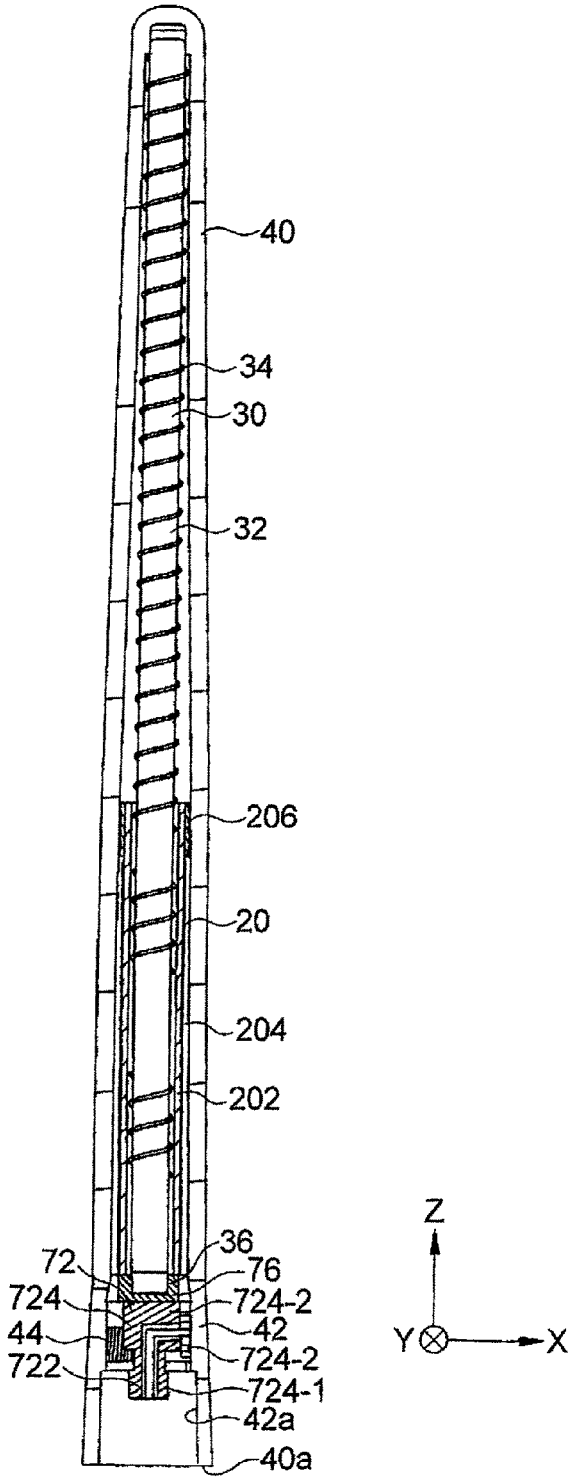
FIG. 5 is a sectional view taken along a line V-V shown in FIG. 4.

As shown in FIGS. 4 and 5, the hollow rod portion 40 has a concave portion 42*a* a lower end 40*a* of which is opened to serve as a male connecting member. On the other hand, the base portion 60 has a convex portion 62 configured to be fitted into the concave portion 42*a* to serve as a female connecting member.

The first coaxial connecting portion 72 has a rod-side signal transmitting member 722 and a rod-side outer conductor 724. The rod-side signal transmitting member 722 is concentrically provided with respect to a center axis of the hollow rod portion 40, and further, is configured to transmit the first reception signal. The rod-side outer conductor 724 covers the above-explained rod-side signal transmitting member 722 and is configured to transmit the second reception signal. The rod-side outer conductor 724 has a projection 724-1 in which a male screw (not shown) is formed in an outer circumferential face thereof. In this embodiment, the rod-side signal transmitting member 722 is constituted by a terminal pin (center conductor) and an insulating seat made of resin which covers this terminal pin. Then, a peripheral portion of the insulating seat (resin) is covered by the rod-side outer conductor 724.

The second coaxial connecting portion 74 has a base-side signal transmitting member 742 and a base-side outer conductor 744. The base-side signal transmitting member 742 is electrically connected to the rod-side signal transmitting member 722, and is configured to relay the first reception signal which is transmitted via the rod-side signal transmitting member 722 to the circuit board 50. The base-side outer conductor 744 covers an outer circumferential face of the base-side signal transmitting member 742, and is configured to relay the second reception signal which is transmitted via the rod-side outer conductor 724 to the circuit board 50. The base-side outer conductor 744 has a recess 744-1 in which a female screw (not shown) to be meshed with the above-described male screw is formed in an inner circumferential face. In this example, similar to the above-described rod-side signal transmitting member 722, the base-side signal transmitting member 742 shown in this drawing is constituted by a terminal pin (center conductor) and an insulating seat made of resin which covers the terminal pin. Then, a peripheral portion of this insulating seat is covered by the base-side outer conductor 744.

Both the rod-side signal transmitting member 722 and the base-side signal transmitting member 724 are operated as an unbalanced line having an impedance of 50 ohms.

Figure 6:
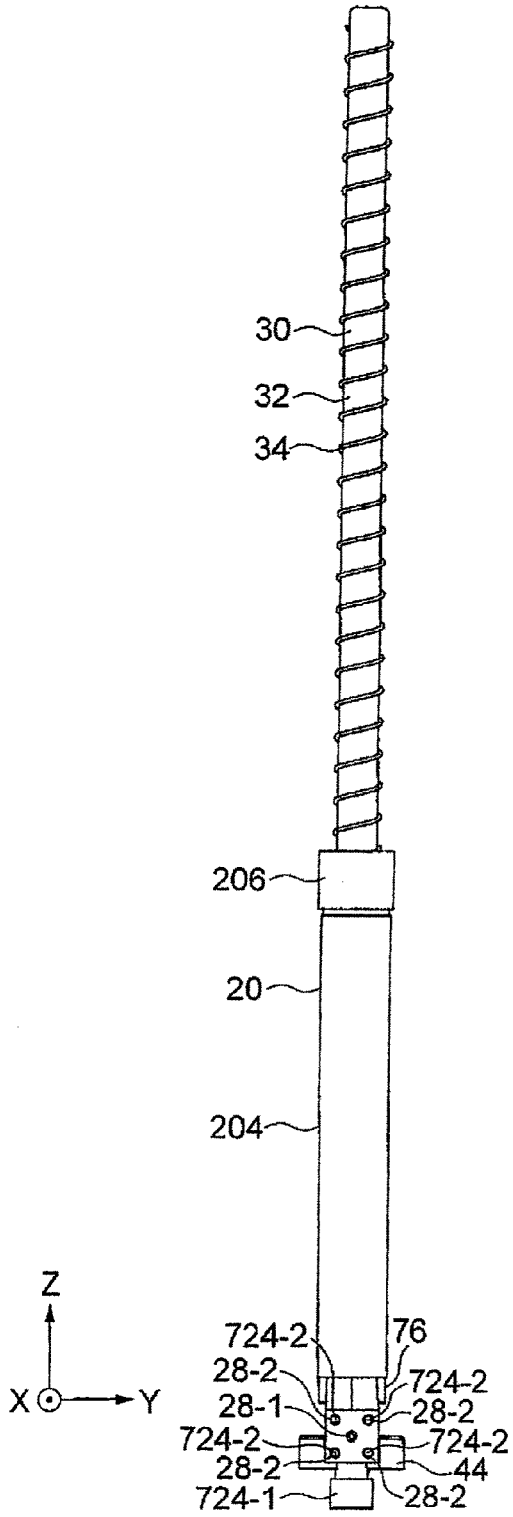
FIG. 6 is a front view showing a first antenna element and a second antenna element which are stored in the rod portion.
Figure 7:
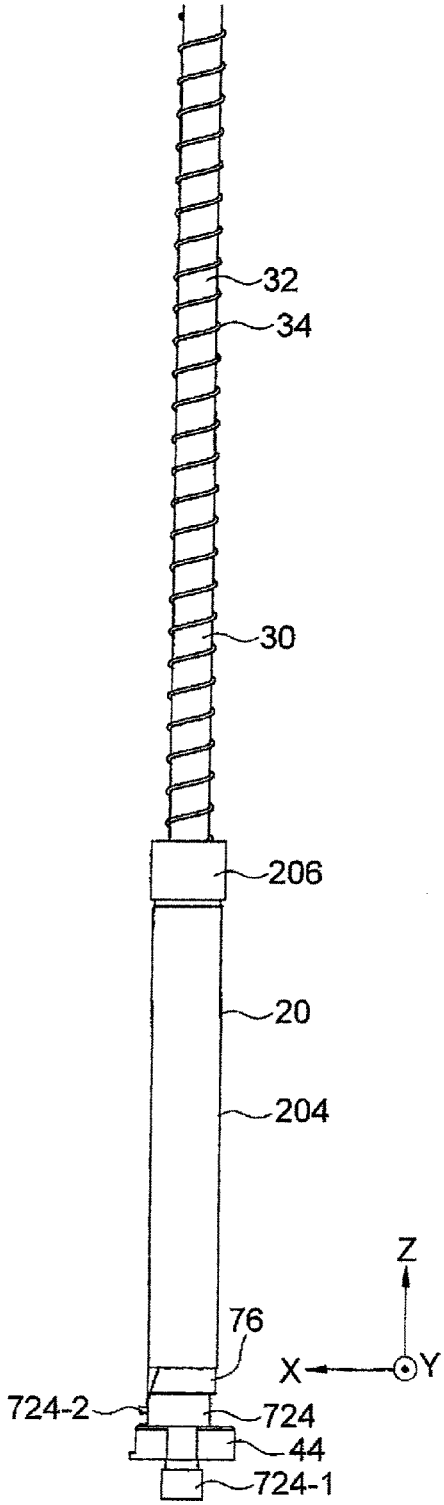
FIG. 7 is a right side view showing the first antenna element and the second antenna element which are stored in the rod portion.

As shown in FIGS. 6 and 7, the first antenna element 20 is made of a cylindrical helical antenna, and the second antenna element 30 is made of a rod antenna provided in such a manner that the second antenna element 30 passes through a central portion of the cylindrical first antenna element 20. The second antenna element 30 shown in this drawing is constructed of a rod portion 32 and a winding 34. The rod portion 32 is elongated along the longitudinal direction (Z-axis direction) of the hollow rod portion 40. The winding 34 is wound on an outer circumferential face of the rod portion 32. The rod portion 32 is constructed of a flexible material. This winding 34 is continuously wound from an upper edge of the rod portion 32 to a lower edge thereof. The winding 34 includes a portion where a wire is uniformly wound, and another winding portion where a wire is wound with wide intervals so as to extend almost straight.

The first antenna element 20 corresponds to an SDARS antenna which receives electromagnetic waves transmitted from the SDARS satellites. The first antenna element 20 is constituted by a cylindrical member 202, and an insulating film member 204 provided with an antenna/phase shifter pattern. The cylindrical member 202 is concentrically located with respect to the center axis of the hollow rod portion 40, and is elongated along the Z-axis direction. The insulating film member 204 provided with the antenna/phase shifter pattern is wound on an outer face of the cylindrical member 202. The cylindrical member 202 is made of a hard material.

A voltage generated at the center portion of the cylindrical member 202 of the first antenna element 20 is very low. As a consequence, even when the second antenna element 30 is set at the center portion of this cylindrical member 202, interference occurred between the first antenna element 20 and the second antenna element 30 is very low.

Figure 8B:
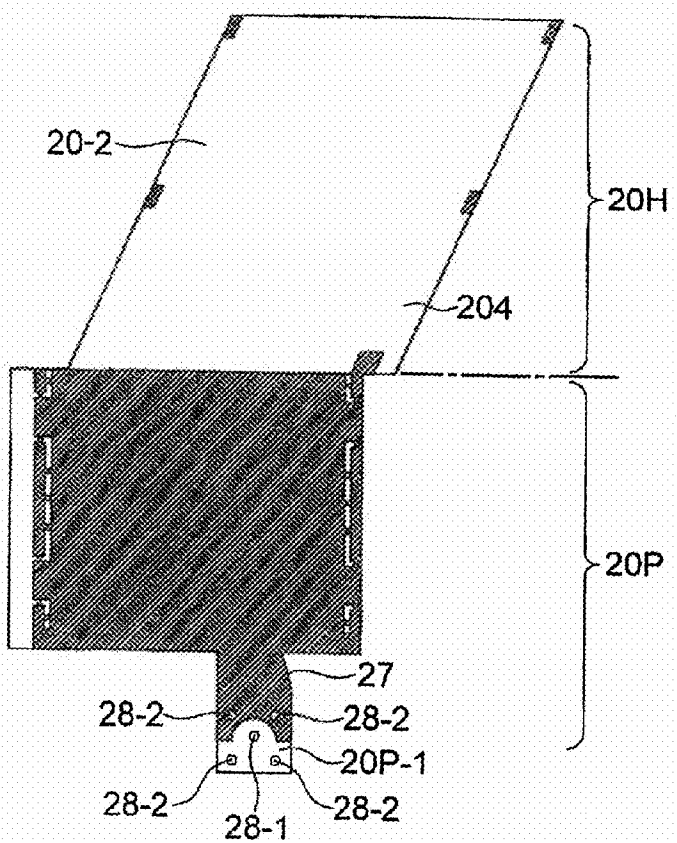
FIG. 8B is a plan view showing a second face (inner circumferential face) of the insulating film member provided with an antenna/phase shifter pattern.
Figure 8A:
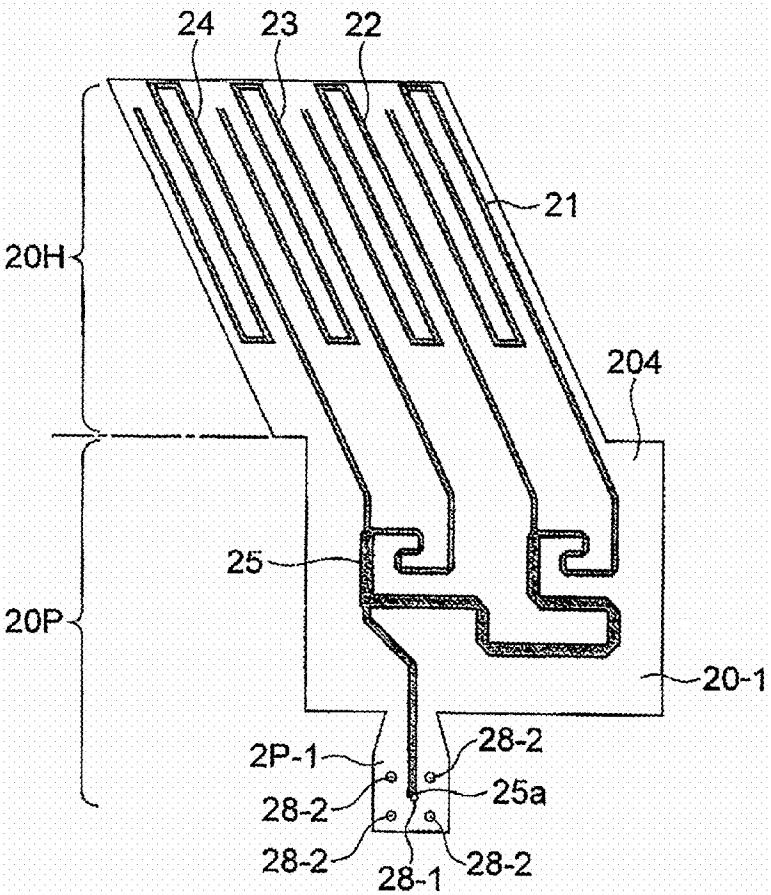
FIG. 8A is a plan view showing a first face (outer circumferential face) of an insulating film member provided with an antenna/phase shifter pattern.

FIG. 8 shows the insulating film member having the flexibility which is similar to shown in FIG. 2 of the above-described Patent Document 3. In the following description, this insulating film member 204 provided with the antenna/phase shifter pattern will be simply referred to as an "insulating film member."

The insulating film member 204 is constituted by a helical antenna portion 20H and a phase shifter portion 20P. The helical antenna portion 20H has substantially a shape of parallelogram, whereas the phase shifter portion 20P has a substantially rectangular shape.

One pair of side edges of the insulating film member 204 are connected in such a manner that a first face 20-1 constitutes an outer circumferential face so as to be wound on the outer face of the cylindrical member 202. When one pair of the side edges are connected to each other, for instance, a pressure-sensitive double-sided adhesive tape, an adhesive agent, soldering, or other means may be employed.

Antenna patterns made of first to four conductors 21 to 24 are formed on the first face 20-1 of the helical antenna portion 204. The first to four conductors 21 to 24 are formed in such a manner that the first to four conductors 21 to 24 are elongated parallel to the side edges respectively under such a condition that the first to four conductors 21 to 24 are bent twice in an opposite direction along the Z-axis direction. As a consequence, as previously explained, when the insulating film member 204 is rounded to form a cylindrical body, the first to four conductors 21 to 24 are elongated in a helix form and may be formed under such a condition that each of the first to four conductors 21 to 24 is bent twice in the opposite direction along the longitudinal direction (Z-axis direction) of the hollow rod portion 40. The antenna patterns made of the first to four conductors 21 to 24 serve as a helical antenna.

A phase shifter pattern 25 electrically connected to the above-described antenna patterns is formed on the first face 20-1 of the phase shifter portion 20P. As a consequence, as previously explained, when the insulating film member 204 is rounded in a cylindrical body, the phase shifter pattern 25 may be formed on the outer circumferential face of the cylindrical body. This phase shifter pattern 25 is operated as a phase shifter.

A ground pattern 27 is formed on a second face 20-2 of the phase shifter portion 20P. In other words, the ground pattern is formed on such a face located opposite to the face where the phase shifter pattern 25 is formed. As a consequence, as previously explained, when the insulating film member 204 is rounded in the cylindrical body, the ground pattern 27 may be formed on an inner circumferential face of the cylindrical body, namely, such a face located opposite to the place where the phase shifter pattern 25 is formed. This ground pattern 27 is provided in such a manner that this ground pattern 27 covers the phase shifter pattern 25 to serve as a shield member.

The phase shifter portion 20P has a tongue piece portion 20P-1 which is projected downward. An output terminal 25*a* of the phase shifter pattern 25 is provided on this torque piece portion 20P-1. A hole 28-1 is formed at a position corresponding to the output terminal 25*a*. Positioning holes 28-2 are formed at four positions on diagonal lines, so that the hole 28-1 is located as a position that the diagonal lines intersect with each other.

As shown in FIG. 6, the rod-side outer conductor 724 has four pieces of positioning projections 724-2 which are projected forward along the X-axis direction. These four positioning projections 724-2 are inserted into the above-described four positioning holes 28-2 and then fixed by soldering. It should also be noted that the output terminal 25*a* of the above-described phase shifter pattern 25 is electrically connected via the above-described hole 28-1 to a center conductor of the rod-side signal transmitting member 722.

Referring also to FIGS. 2 and 3 in addition to FIGS. 6 and 7, a cylindrical spacer 206 is provided on the upper edge portion of the cylindrical member 202 located above the insulating film member 204. In other words, the cylindrical spacer 206 is arranged between an inner wall of the hollow rod portion 40 and the cylindrical member 202 of the first antenna element 20. As a consequence, a gap between the inner wall of the hollow rod portion 40 and the first antenna element 20 can be kept constant.

As shown in FIG. 5, a cylindrical caulking 76 is provided at a lower portion of the cylindrical member 202 of the first antenna element 20 and at a lower portion of the rod portion 32 of the second antenna element 30. Also, an electric conducting member 36 is mounted on an outer circumferential face of the lower portion of the rod portion 32, while the electric conducting member 36 is made of a copper tape connected to the winding 34. The electric conducting member 36 of the rod portion 32 is forced to be inserted into the cylindrical caulking 76, and is caulked so as to be fixed. It is also possible to eliminate the electric conductive member 36 in such a case that the winding 34 of the second antenna element 30 is soldered to the cylindrical caulking 76, or is fixed only by the cylindrical caulking 76.

A spacer 44 is provided between an inner wall of the proximal end portion 42 of the hollow rod portion 40 and the rod-side outer conductor 724 of the first coaxial connecting portion 72. In other words, the spacer 44 is arranged between the inner wall of the proximal end portion 42 of the hollow rod portion 40 and the rod-side outer conductor 724 of the first coaxial connecting portion 72.

As shown in FIGS. 2 and 3, the base portion 60 is constructed of a cover 64 and a base 66. The circuit board 50 is constituted by a first board 51 and a second board 52, which are arranged on a major face of the base 66 along a vertical direction and in a parallel manner with respect to the major face. The first board 51 is electrically connected to the base-side signal transmitting member 742. The second board 52 is electrically connected to a base-side outer conductor 744. A board-side outer conductor 82 is mounted on the first board 51. This board-sideboard-side outer conductor 82 is electrically connected to the base-side outer conductor 744. A base-side signal transmitting member 742 passes through a center portion of this board-side outer conductor 82 and then is connected to the first board 51. On the other hand, while a conducting wire 84 is projected from a rear face of the board-side outer conductor 82, this conducting wire 84 is connected to the second board 52.

As a consequence, the first reception signal received by the first antenna element 20 is transmitted to the first board 51 via both the rod-side signal transmitting member 722 of the first coaxial connecting portion 72 and the base-side signal transmitting member 742 of the second coaxial connecting portion 74. A first LNA circuit (not shown) is mounted on the first board 51. This first LNA circuit serves as an amplifier for the first reception signal.

The second reception signal received by the second antenna element 30 is transmitted to the second board 52 via the cylindrical caulking 36, the rod-side outer conductor 724 of the first coaxial connecting portion 72, the base-side outer conductor 744 of the second coaxial connecting portion 74, the board-side outer conductor 82, and the conducting wire 84. An amplifying circuit (not shown) is mounted on the second board 52. This amplifying circuit is configured to amplify the second reception signal.

According to the first embodiment of the present invention, since the connector 70 is utilized so as to transmit the first reception signal received by the first antenna element 20 and the second reception signal received by the second antenna element 30 from the hollow rod portion 40 to the circuit board 50, both the coupling device and the signal separator are no longer required, which were required in the conventional composite antenna apparatus. As a consequence, the distribution loss can be suppressed. As a result, the reception sensitivities achieved in the first antenna element 20 and the second antenna element 30 of the composite antenna apparatus 10 can be improved.

Figure 9:
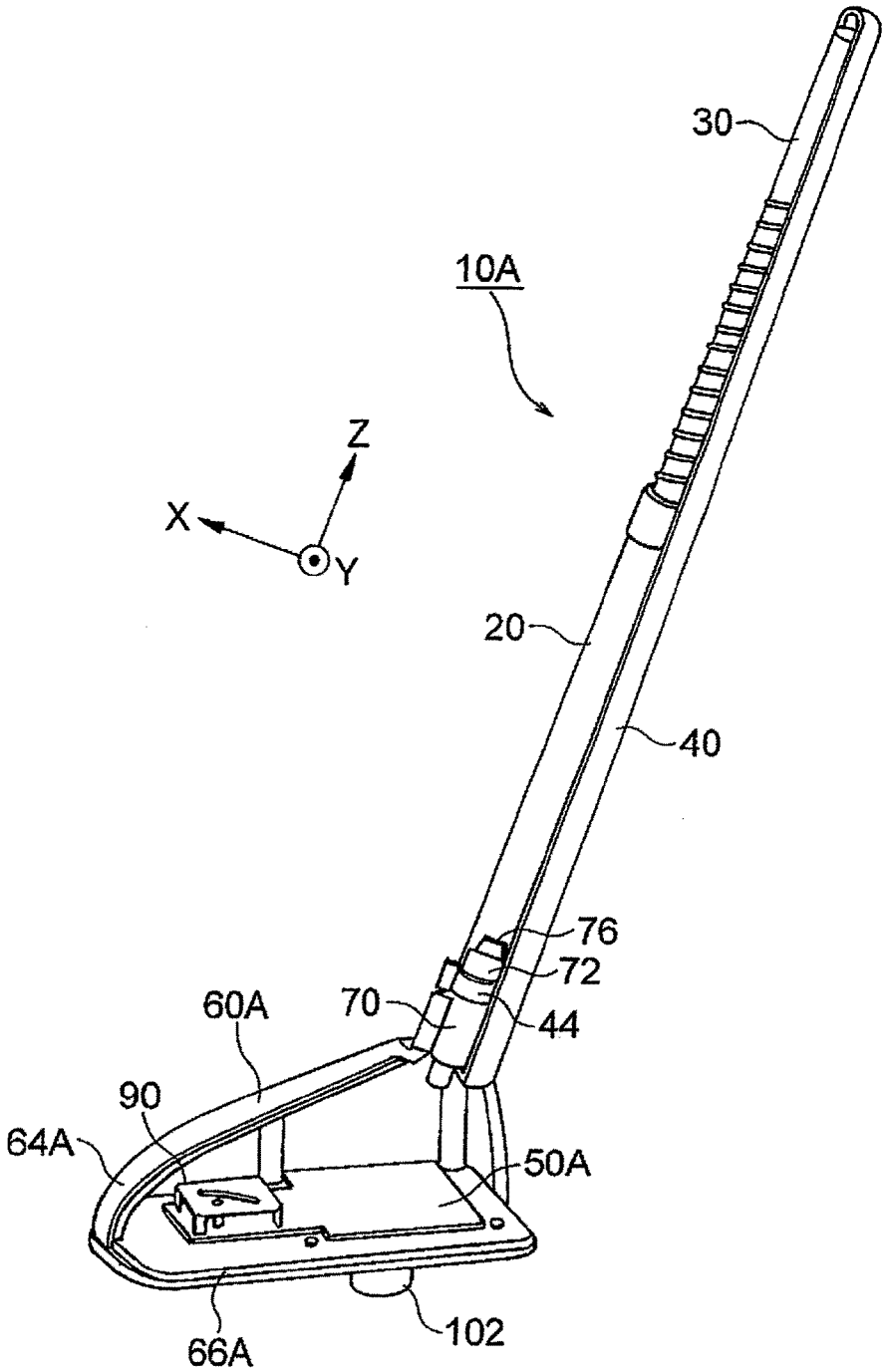
FIG. 9 is a partially sectional view showing the composite antenna apparatus according to a second embodiment of the invention, wherein the right side face of which is partially cut out.

With reference to FIG. 9, there will be described a composite antenna apparatus 10A according to a second embodiment of the present invention. The composite antenna apparatus 10A in this embodiment has a similar structure to the first embodiment except that this composite antenna apparatus 10A is further equipped with a third antenna element 90, and structures as to a base portion and a circuit board are different. Accordingly, reference numerals of "60A" and "50A" are assigned to the base portion and the circuit board, respectively.

Components similar to those in the first embodiment (previous embodiments) will be denoted by the same reference numerals and repetitive explanations for those will be omitted.

In FIG. 9, a longitudinal direction (height direction) is expressed by a Z-axis direction along which the hollow rod portion 40 is elongated; a right and left direction (width direction) is expressed by a Y-axis direction; and further, a direction (front-rear direction, namely depth direction) which is intersected with the Z-axis direction and the Y-axis direction at a right angle is expressed by an X-axis direction.

The base portion 60A has a cover 64A and a base 66A. The circuit board 50A is mounted on a major face of the base 66A parallel to the major face. The third antenna element 90 is mounted on the circuit board 50A. The third antenna element 90 is mounted on the circuit board 50A on the opposite side with respect to the side that the hollow rod portion 40 is provided.

The third antenna element 90 is a planar antenna constituted by a sheet metal patch antenna. The planar antenna 90 corresponds to a GPS antenna which receives electromagnetic waves transmitted from the GPS satellites.

Figure 10:
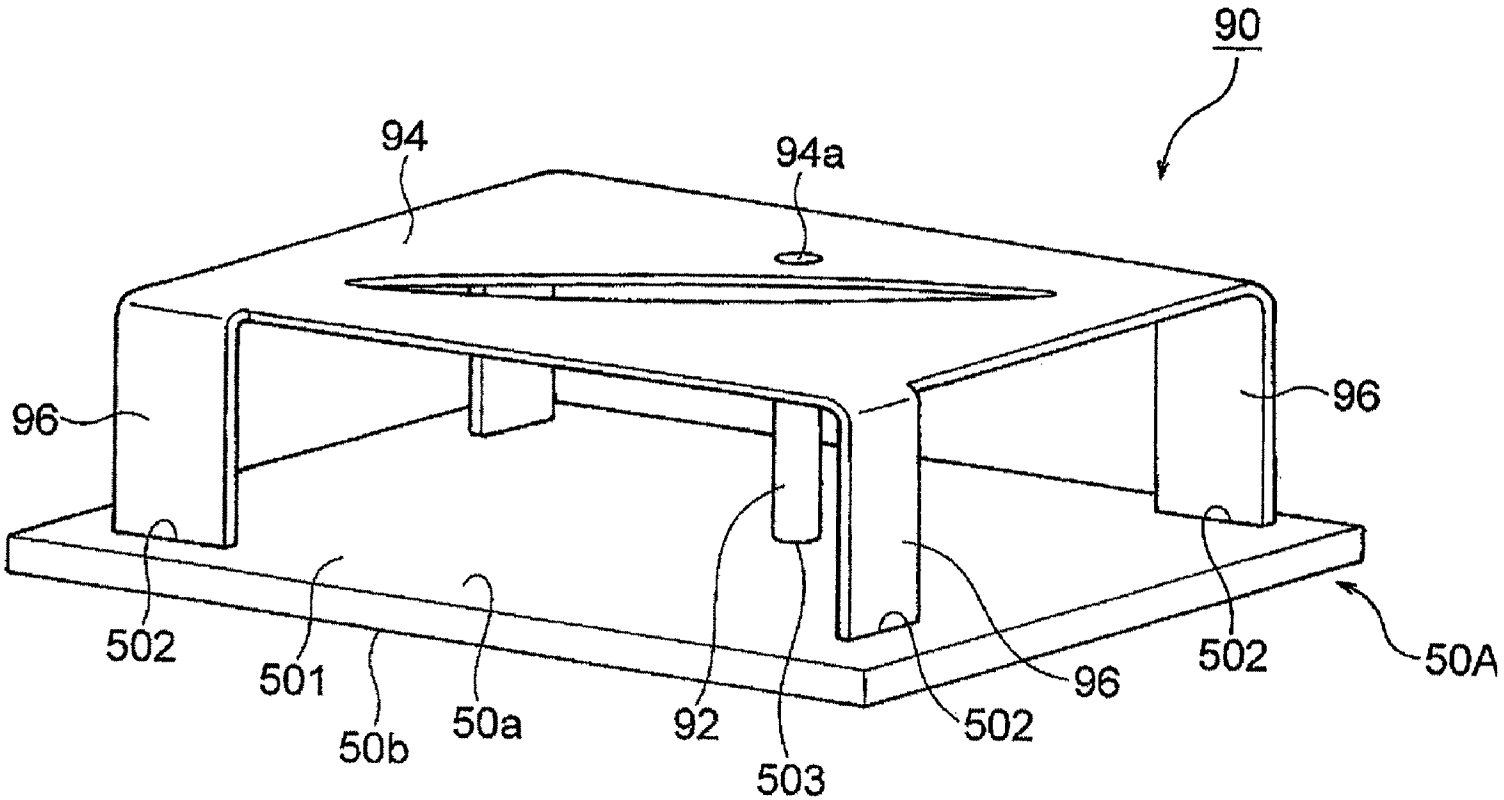
FIG. 10 is a perspective view of a sheet metal patch antenna incorporated in the composite antenna of FIG. 9.

As shown in FIG. 10, the third antenna element 90 may be a sheet metal patch antenna.

The circuit board 50A has an electric conductor layer 501 such as a thin copper film on an upper face (major face) 50*a* thereof. This electric conductor layer 501 is operated as a ground conductor. A portion of the circuit board 50A on which the sheet metal patch antenna 90 is mounted (will be referred to as "antenna element mounting portion" hereinafter) is formed in a substantially rectangular shape. Through holes 502 are formed in areas located in the vicinity of respective corner portions of the antenna element mounting portion of the circuit board 50A. An insertion hole 503 into which a power supply pin 92 is inserted is formed at a position of the circuit board 50A, which is slightly deviated from the center of the antenna element mounting portion thereof.

Although not shown in the drawing, conducting portions are provided on peripheral edges of the through holes 502 in the upper face 50*a* of the circuit board 50A in such a manner that these conducting portions surround the through holes 502. Insulating portions are provided on the peripheral edges of the conducting portions and the peripheral edge of the insertion hole 503 in such a manner that the insulating portions surround both the conducting portions and the insertion hole 503. Then, a circuit element such as a second LNA circuit (not shown) mounted on a lower face (rear face) 50*b* of the circuit board 50A is mounted. This second LNA circuit corresponds to such a circuit which amplifies a third reception signal received by the third antenna element 90. The third reception signal may be the GPS signal.

The power supply pin 92 is inserted into the insertion hole 503 of the circuit board 50A in such a manner that this power supply pin 92 passes through the circuit board 50A. A lower edge portion of the power supply pin 92 is connected to an input unit of the second LNA circuit, while the lower edge portion of the power supply pin 92 is such an edge portion of this power supply pin 92 projected from the lower face 50*b* of the circuit board 50A.

A flat plate-shaped antenna element 94 is provided above the upper face 50*a* of the circuit board 50A in such a manner that this flat plate-shaped antenna element 94 extends parallel to the circuit board 50A and opposes the circuit board 50A across a gap. The flat-shaped antenna element 94 is constructed of a rectangular-shaped metal face (for instance, copper plate) which has a smaller dimension than that of the antenna element mounting portion of the circuit board 50A.

At portions located near the respective corner positions of the flat-shaped antenna element 94, leg pieces 96 made of flat metal plates are formed as a part of the flat-shaped antenna element 94 and bent toward the circuit board 50A. The leg pieces 96 may not be monolithically formed with the flat-shaped antenna element 94.

It should also be noted that the leg pieces 96 may be merely arranged in a substantially centrosymmetry manner with respect to the center of the flat-shaped antenna element 94. It should also be noted that the present invention is not limited only to a total number of these leg pieces 96 as well as shapes of these leg pieces 96, which are exemplified in this second embodiment.

Edge portions of these plural leg pieces 96 on the side of the circuit board 50A are fitted into the through holes 502, and then, penetrate from the upper face 50*a* of the circuit board 50A toward the lower face 50*b* thereof, while these transparent holes 502 are formed in the areas located near the respective corner portions of the antenna element mounting portion of the circuit board 50A.

A feeding point 94*a* is provided at a position which is slightly deviated from the center of the flat-shaped antenna element 94. An upper edge portion of the power supply pin 92 which passes through the circuit board 50A is soldered on this feeding point 94*a*.

As a consequence, the first LNA circuit which amplifies the first reception signal received by the first antenna element 20, the amplifying circuit which amplifies the second reception signal received by the second antenna element rod antenna 30, and also, the second LNA circuit which amplifies the third reception signal received by the third antenna element 90 are formed on the circuit board 50A, respectively.

In the composite antenna apparatus 10A shown in the drawings, since two pieces of planar antennas are not arranged on the circuit board 50A, interference between the antenna elements thereof can be suppressed. This antenna arrangement is advantageous in connection with directivity and gain characteristic aspects.

In the conventional composite antenna apparatus, when the third antenna element and the first antenna element are arranged in a parallel manner, if the first and third antennas are arranged to be closed to each other, then the interference may occur due to the directivity, which may deteriorate the reception characteristics thereof. To the contrary, in the composite antenna apparatus 10A, since the first antenna element 20 is stored in the hollow rod portion 40 and the third antenna element 90 is mounted on the circuit board 50A in such a manner that the first antenna element 20 is separated from the third antenna element 90, the interference between the first antenna element 20 and the third antenna element 90 can be suppressed. As a result, the first antenna element 20 and the third antenna element 90 can receive the electromagnetic waves (namely, SDARS signals and GPS signals) under better conditions, respectively.

Since the sheet metal patch antenna is employed as the third antenna element 90, the vibration resistant characteristic can be improved. When vibrations are applied to a normal flat face type patch antenna, a self-weight of this patch antenna is applied to a power supply pin of the own patch antenna, resulting in stresses. To the contrary, when the third antenna element 90 is employed, since the connecting positions are increased in the four leg pieces 96 and the power supply pin 92, the stresses can be distributed. Also, since the self-weight of the third antenna element 90 is light, even when the self-weight of the third antenna element 90 is applied to the power supply pin 92, the resultant stress is very weak.

Since the second antenna element 30 and the first antenna element 20 are unified in the hollow rod portion 40, these first and second antenna elements 20 and 30 are not adversely influenced by the interference given from the third antenna element 90. Since any other structural elements than the third antenna element 90 are not stored in the base portion 60A, the composite antenna apparatus 10A can be made compact.

Figure 11:
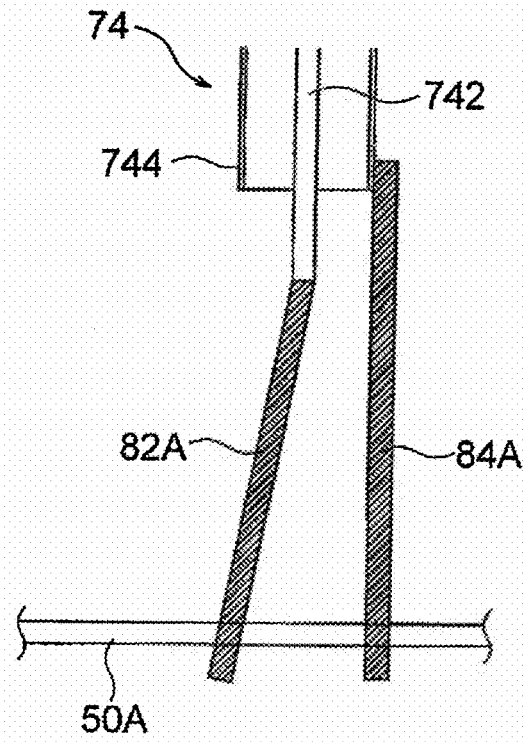
FIG. 11 is a schematic view showing a first example to connect a second coaxial connecting portion and a circuit board in the composite antenna shown in FIG. 9.
Figure 12:
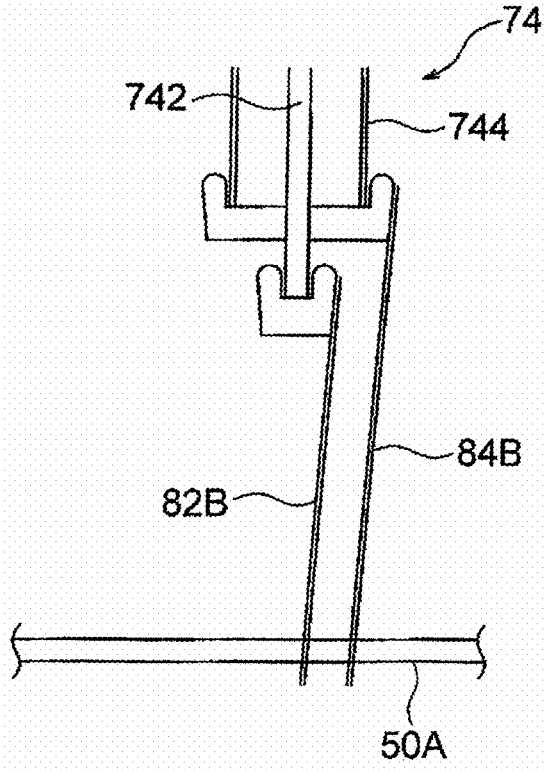
FIG. 12 is a schematic view showing a second example to connect the second coaxial connecting portion and the circuit board in the composite antenna shown in FIG. 9.

Referring to FIGS. 11 and 12, there will be described how to electrically connect the second coaxial connecting portion 74 to the circuit board 50A in the composite antenna apparatus 10A. The second coaxial connecting portion 74 may be female type connector portion.

A first example will be described with reference to FIG. 11. The terminal pin of the base-side signal transmitting member 742 of the second coaxial connecting portion 74 is connected via a first lead wire 82A to the circuit board 50A, whereas the base-side outer conductor 744 of the second coaxial connecting portion 74 is connected via a second lead wire 84A to the circuit board 50A.

A second example will be described with reference to FIG. 12. The terminal pin of the base-side signal transmitting member 742 of the second coaxial connecting portion 74 is connected via a first connection 82B to the circuit board 50A, whereas the base-side outer conductor 744 of the second coaxial connecting portion 74 is connected via a second connection fitting 84B to the circuit board 50A.

A third example will be described. One of the terminal pin of the base-side signal transmitting member 742 and the base-side outer conductor 744 may be connected via a lead wire to the circuit board 50A, and the other may be connected via a connection fitting to the circuit board 50A.

A third example will be described. Both the terminal pin of the base-side signal transmitting member 742 and the base-side outer conductor 744 may be connected to the circuit board 50A by utilizing an exclusive connection fitting.

Although the present invention is described with reference to the preferred embodiments, it is apparent that the present invention is not limited only to the above-described embodiments. For instance, in the above-described embodiments, the lengths as to the hollow rod portion 40 and the second antenna element rod antenna 30 are fixed. Alternatively, both a rod portion and a second antenna element rod antenna may be constructed in such a manner that lengths thereof may be freely adjusted in a telescopic manner. Also, the first antenna element 20, the second antenna element 30 and third antenna element 90 may not be limited only to the above-described antenna structures realized in the above-explained embodiments, and alternatively, may be realized by employing various sorts of structures other than the above-described antenna structures. For instance, in the above-described embodiments, as the first antenna element 20, such a helical antenna is utilized that the insulating film member 204 provided with the antenna/phase shifter pattern is wound on the cylindrical member 202. Alternatively, another helical antenna may be used in which at least one conductor is wound on a cylindrical member. When only single conductor is employed, the phase shifter portion 20P is no longer required. Also, in the above-described embodiments, as the second antenna element 30, such a rod antenna is employed in which the winding 34 is wound on the outer circumferential face of the rod portion 32. Alternatively, any other rod antennas may be employed if these rod antennas may be inserted into the inner space of the cylindrical helical antenna. Moreover, in the second embodiment, as the third antenna element 90, the sheet metal patch antenna is used. The present invention is not limited only to this sheet metal patch antenna, but may employ planer antennas having various sorts of antenna structures. For example, The rod-side outer conductor 724 may have a recess in which a female screw is formed in the inner circumferential face thereof, and the base-side outer conductor 744 may have a projection in which a male screw to be meshed with the female screw is formed in the outer circumferential face thereof. Further, a cover covering the projection may be formed on the base portion 60.

What is claimed is:

1. A composite antenna apparatus comprising:

a first antenna element;

a second antenna element;

a rod member accommodating the first antenna element and the second antenna element therein;

a circuit board;

a base member accommodating the circuit board therein; and a connector mechanically coupling an end portion of the rod member and the base member so as to transmit a first signal received by the first antenna element and a second signal received by the second antenna element to the circuit board, the connector comprising:

a first conductive member configured to transmit the first signal to the circuit board therethrough; and a second conductive member configured to transmit the second signal to the circuit board therethrough, wherein the connector comprises a first part provided on the end portion of the rod member and a second part provided on the base member and configured to be coupled with the first part, the first conductive member includes:

a first inner conductive member provided in the first part and being concentric with an axis of the rod member; and a second inner conductive member provided in the second part and electrically connected to the first inner conductive member and the circuit board, and the second conductive member includes:

a first outer conductive member provided in the first part, protruded from the end portion of the rod member, and covering the first inner conductive member; and a second outer conductive member, provided in the second part, configured to fit with the first outer conductive member, and electrically connected to the first outer conductive member and the circuit board, the second outer conductive member covering the second inner conductive member.

2. The composite antenna apparatus set forth in claim 1, wherein:

the composite antenna apparatus is configured to be disposed on either a roof or a quarter panel of a vehicle.

3. The composite antenna apparatus set forth in claim 1, wherein:

the first part and the second part are configured to be detachably screw-fitted with each other.

4. The composite antenna apparatus set forth in claim 3, wherein:

the first outer conductive member is formed with a male screw; and the second outer conductive member is formed with a female screw configured to fit with the male screw.

5. The composite antenna apparatus set forth in claim 1, wherein:

the first antenna element includes a helical antenna having a tubular body; and the second antenna element includes a rod antenna disposed in the tubular body.

6. The composite antenna apparatus set forth in claim 5, wherein:

the rod antenna is configured to receive an AM broadcast and a FM broadcast.

7. The composite antenna apparatus set forth in claim 5, wherein:

the helical antenna is configured to receive electric waves of a Satellite Digital Audio Radio Service.

8. The composite antenna apparatus set forth in claim 1, wherein:

the base member comprises a cover and a plate;

the circuit board comprises a first circuit board and a second circuit board which extend parallel to each other and perpendicularly to the plate;

the first circuit board is electrically connected to the second inner conductive member, the second circuit board is electrically connected to the second outer conductive member.

9. The composite antenna apparatus set forth in claim 1, further comprising:

a third antenna element mounted on the circuit board.

10. The composite antenna apparatus set forth in claim 9, wherein:

the third antenna element comprises a planar antenna.

11. The composite antenna apparatus set forth in claim 10, wherein:

the planar antenna comprises a patch antenna.

12. The composite antenna apparatus set forth in claim 9, wherein:

the third antenna element is configured to serve as a GPS antenna receiving a GPS signal.

13. The composite antenna apparatus set forth in claim 1, further comprising:

a connector cover extending from the end portion of the rod member and covering the first part.

* * * * *